US010514223B1

(12) United States Patent
Rounds

(10) Patent No.: US 10,514,223 B1
(45) Date of Patent: Dec. 24, 2019

(54) FIREARM TRIGGER MECHANISM

(71) Applicant: Wolf Tactical LLC, Buda, TX (US)

(72) Inventor: Jeffrey Cooper Rounds, Buda, TX (US)

(73) Assignee: Wolf Tactical LLC, Buda, TX (US)

( * ) Notice: Subject to any disclaimer, the term of this patent is extended or adjusted under 35 U.S.C. 154(b) by 0 days.

(21) Appl. No.: 16/143,624

(22) Filed: Sep. 27, 2018

Related U.S. Application Data

(60) Provisional application No. 62/565,247, filed on Sep. 29, 2017.

(51) Int. Cl.

| | |
|---|---|
| ***F41A 19/43*** | (2006.01) |
| ***F41A 19/14*** | (2006.01) |
| ***F41A 19/10*** | (2006.01) |
| ***F41A 19/12*** | (2006.01) |
| *F41A 17/82* | (2006.01) |

(52) U.S. Cl.
CPC ..... *F41A 19/43* (2013.01); *F41A 19/10* (2013.01); *F41A 19/12* (2013.01); *F41A 19/14* (2013.01); *F41A 17/82* (2013.01)

(58) Field of Classification Search
CPC ..... F41A 19/10; F41A 19/12; F41A 19/14; F41A 19/43; F41A 17/82
USPC ..... 89/136, 139; 42/69.01, 69.02, 69.03
See application file for complete search history.

(56) References Cited

U.S. PATENT DOCUMENTS

| | | | | |
|---|---|---|---|---|
| 5,704,153 | A * | 1/1998 | Kaminski | F41A 17/063 42/117 |
| 6,101,918 | A | 8/2000 | Akins | |
| 6,722,072 | B1 | 4/2004 | McCormick | |
| 7,162,824 | B1 | 1/2007 | McCormick | |
| 7,213,359 | B2 | 5/2007 | Beretta | |
| 7,293,385 | B2 | 11/2007 | McCormick | |
| 7,398,723 | B1 | 7/2008 | Blakley | |

(Continued)

FOREIGN PATENT DOCUMENTS

| | | |
|---|---|---|
| TW | 409847 U | 10/2000 |

*Primary Examiner* — Bret Hayes
(74) *Attorney, Agent, or Firm* — Wood Herron & Evans LLP

(57) ABSTRACT

A trigger mechanism for use in a firearm having a receiver with a fire control mechanism pocket, transversely aligned pairs of hammer and trigger pin openings in the pocket, and a bolt carrier that reciprocates and pivotally displaces a hammer when cycled. The trigger mechanism includes a hammer, a trigger member, and a locking bar. The hammer has a sear notch and is mounted in the fire control mechanism pocket to pivot on a transverse hammer pin between set and released positions. The trigger member has a sear and is mounted in the fire control mechanism pocket to pivot on a transverse trigger pin between set and released positions. The trigger member has a surface positioned to be contacted by hammer when the hammer is displaced by cycling of the bolt carrier, the contact causing the trigger member to be forced to the set position. The locking bar is pivotally mounted in a frame and spring biased toward a first position in which it mechanically blocks the trigger member from moving to the release position, and is movable against the spring bias to a second position when contacted by the bolt carrier reaching a substantially in-battery position, allowing the trigger member to be moved by an external force to the released position.

7 Claims, 4 Drawing Sheets

(56) References Cited

U.S. PATENT DOCUMENTS

| | | | | |
|---|---|---|---|---|
| 8,127,658 | B1 | 3/2012 | Cottle | |
| 8,820,211 | B1 | 9/2014 | Hawbaker | |
| 9,021,732 | B2 | 5/2015 | Johnson | |
| 9,513,076 | B2 * | 12/2016 | Kolev | F41A 3/12 |
| 9,568,264 | B2 | 2/2017 | Graves | |
| 9,816,772 | B2 | 11/2017 | Graves | |
| 9,939,221 | B2 | 4/2018 | Graves | |
| 2007/0199435 | A1 * | 8/2007 | Hochstrate | F41A 3/66 89/191.02 |
| 2016/0010933 | A1 | 1/2016 | Bonner | |
| 2016/0102933 | A1 | 4/2016 | Graves | |
| 2017/0219307 | A1 * | 8/2017 | Foster | F41A 19/06 |
| 2018/0066911 | A1 | 3/2018 | Graves | |
| 2018/0087860 | A1 * | 3/2018 | Sullivan | F41A 17/46 |

* cited by examiner

FIREARM TRIGGER MECHANISM

RELATED APPLICATIONS

This application claims priority to U.S. Provisional Patent Application No. 62/565,247 filed Sep. 29, 2017, and incorporates the same herein by reference.

TECHNICAL FIELD

This invention relates to a firearm trigger mechanism. More particularly, it relates to a semiautomatic trigger that is mechanically reset by movement of the hammer when it is reset by the bolt carrier.

BACKGROUND

In a standard semiautomatic firearm, actuation of the trigger releases a sear, allowing a hammer or striker to fire a chambered ammunition cartridge. Part of the ammunitions propellant force is used to cycle the action, extracting and ejecting a spent cartridge and replacing it with a loaded cartridge. The cycle includes longitudinal reciprocation of a bolt and/or carrier, which also resets the hammer or striker.

A standard semiautomatic trigger mechanism includes a disconnector, which holds the hammer or striker in a cocked position until the trigger member is reset to engage the sear. This allows the firearm to be fired only a single time when the trigger is pulled and held, because the user is not typically able to release the trigger rapidly enough so that the sear engages before the bolt or bolt carrier returns to its in-battery position. The disconnector prevents the firearm from either firing multiple rounds on a single pull of the trigger, or from allowing the hammer or striker to simply "follow" the bolt as it returns to battery without firing a second round, but leaving the hammer or striker uncocked.

For various reasons, shooters desire to increase the rate of semiautomatic fire. Sometimes this is simply for entertainment and the feeling of shooting a machine gun. In the past, users have been known to employ "bump firing" to achieve rapid semiautomatic fire. Bump firing uses the recoil of the semiautomatic firearm to fire shots in rapid succession. The process involves bracing the rifle with the non-trigger hand, loosening the grip of the trigger hand (but leaving the trigger finger in its normal position in front of the trigger), and pushing the rifle forward in order to apply pressure on the trigger from the finger while keeping the trigger finger stationary. When fired with the trigger finger held stationary, the firearm will recoil to the rear and allow the trigger to reset as it normally does. When the non-trigger hand pulls the firearm away from the body and back forward toward the original position, it causes the trigger to be pressed against the stationary finger again, firing another round as the trigger is pushed back.

Other devices have been offered that facilitate the bump fire process. One is shown in U.S. Pat. No. 6,101,918, issued Aug. 15, 2000, to William Akins for a Method and Apparatus for Accelerating the Cyclic Firing Rate of a Semiautomatic Firearm. This device, sold for some time as the Akins Accelerator™, allowed the receiver and action of the firearm to move longitudinally relative to the butt stock and used a spring to assist forward return movement. Other devices, such as that shown in U.S. Pat. No. 8,127,658, issued Mar. 6, 2012, and other patents owned by Slide Fire Solutions provide a replacement stock and handgrip assembly that facilitates bump firing, but without spring assistance.

Other solutions to increase the rate of semiautomatic fire include pull/release trigger mechanisms. These devices cause one round to be fired when the trigger is pulled and a second round to be fired when the trigger is released. Such a device is shown in U.S. Pat. No. 8,820,211, issued Sep. 2, 2014, entitled Selectable Dual Mode Trigger for Semiautomatic Firearms. A device like this is offered by FosTecH Outdoors, LLC as the ECHO TRIGGER™. Another device, offered by Digital Trigger Technologies, LLC under the name DigiTrigger™, provides a dual mode trigger in which the pull/release operating function is achieved electronically.

The above-described devices either require practice to use reliably, are complex, and/or are expensive to manufacture and install.

Another device for increasing the rate of semiautomatic fire is shown in U.S. Pat. Nos. 9,568,264; 9,816,772; and U.S. Pat. No. 9,939,221, issued to Thomas Allen Graves. The devices shown in these patents forcefully reset the trigger with rigid mechanical contact between the trigger member and the bolt as the action cycles. This invention, however, does not provide a "drop-in" solution for existing popular firearm platforms, like the AR15, AK47 variants, or the Ruger 10/22™. To adapt this invention to an AR-pattern firearm, for example, would require not only a modified fire control mechanism, but also a modified bolt carrier.

SUMMARY OF INVENTION

The present invention provides a semiautomatic trigger mechanism for increasing rate of fire that can be retrofitted into popular existing firearm platforms. In particular, this invention provides a trigger mechanism that can be used in AR-pattern firearms with an otherwise standard M16-pattern bolt carrier assembly. The present invention is particularly adaptable for construction as a "drop-in" replacement trigger module that only requires insertion of two assembly pins and the safety selector. In the disclosed embodiments, the normal resetting of the hammer, as the bolt or bolt carrier is cycled, causes the trigger to be forcibly reset by contact between the hammer and a surface of the trigger member. Once reset, movement of the trigger is blocked by a locking bar and cannot be pulled until the bolt has returned to battery, thus preventing "hammer follow" behind the bolt or bolt carrier.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures; wherein.

DETAILED DESCRIPTION

Figure 1:
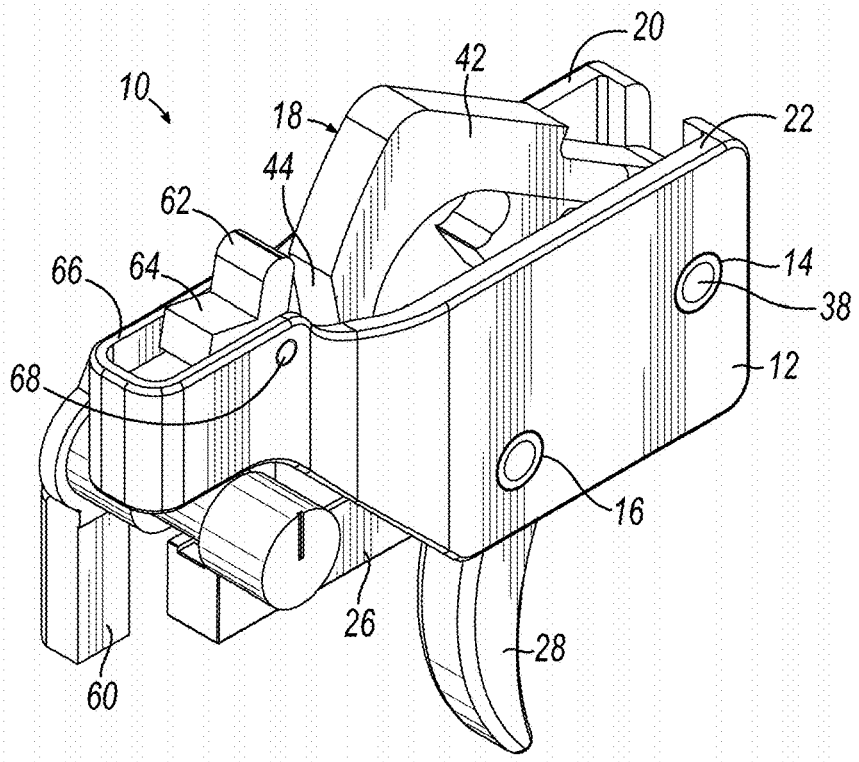
FIG. 1 is an isometric view of a drop-in trigger module for an AR-pattern firearm according to one embodiment of the invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
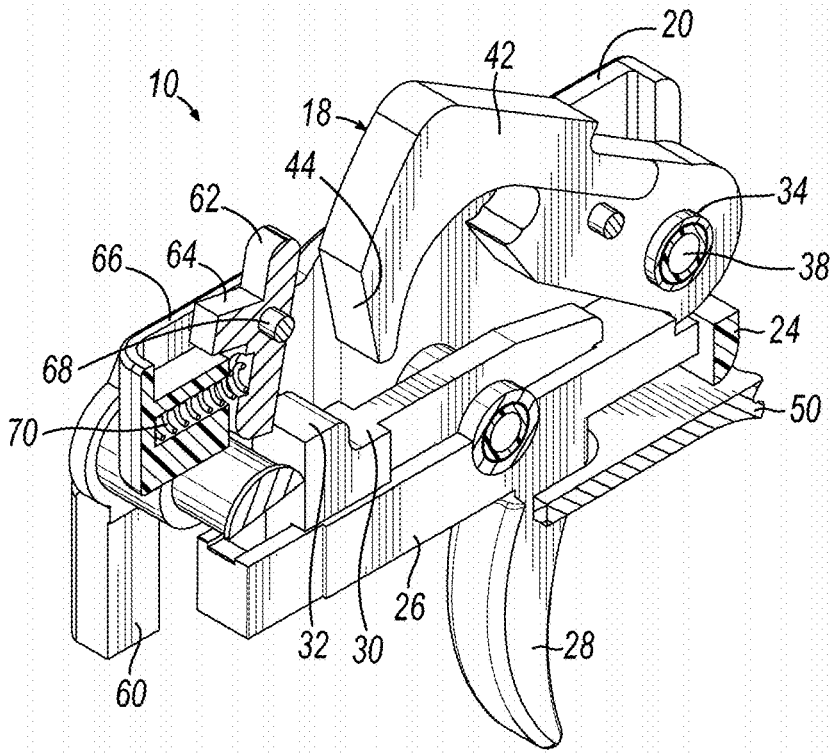
FIG. 2 is a partially cut-away view thereof.

Referring first to FIGS. 1 and 2, therein is shown at 10 a "drop-in" trigger module adapted for use in an AR-pattern firearm according to a first embodiment of the present invention. As used herein, "AR-pattern" firearm includes the semiautomatic versions of the AR10 and AR15 firearms and variants thereof of any caliber, including pistol caliber carbines or pistols using a blow-back bolt. While select fire (fully automatic capable) versions of this platform, such as the M16 and M4, are also AR-pattern firearms, this invention only relates to semiautomatic firearm actions. The concepts of this invention may be adaptable to other popular semiautomatics firearm platforms, such as the Ruger 10/22™ or AK-pattern variants.

The module 10 includes a frame or housing 12 that may be sized and shaped to fit within the internal fire control mechanism pocket of an AR-pattern lower receiver. It includes first and second pairs of aligned openings 14, 16 that are located to receive transverse pins (40, 36, respectively, shown in FIGS. 3-5) used in a standard AR-pattern trigger mechanism as pivot axes for the hammer and trigger member, respectively. The housing 12 includes left and right sidewalls 20, 22, which extend substantially vertically and parallel to one another in a laterally spaced-apart relationship. The sidewalls 20, 22 may be interconnected at the bottom of the housing 12 at the front by a crossmember 24.

A hammer 18 of ordinary (MIL-SPEC) AR-pattern shape and construction may be used. The illustrated hammer 18 may be standard in all respects and biased by a typical AR-pattern hammer spring (not shown).

Figure 3:
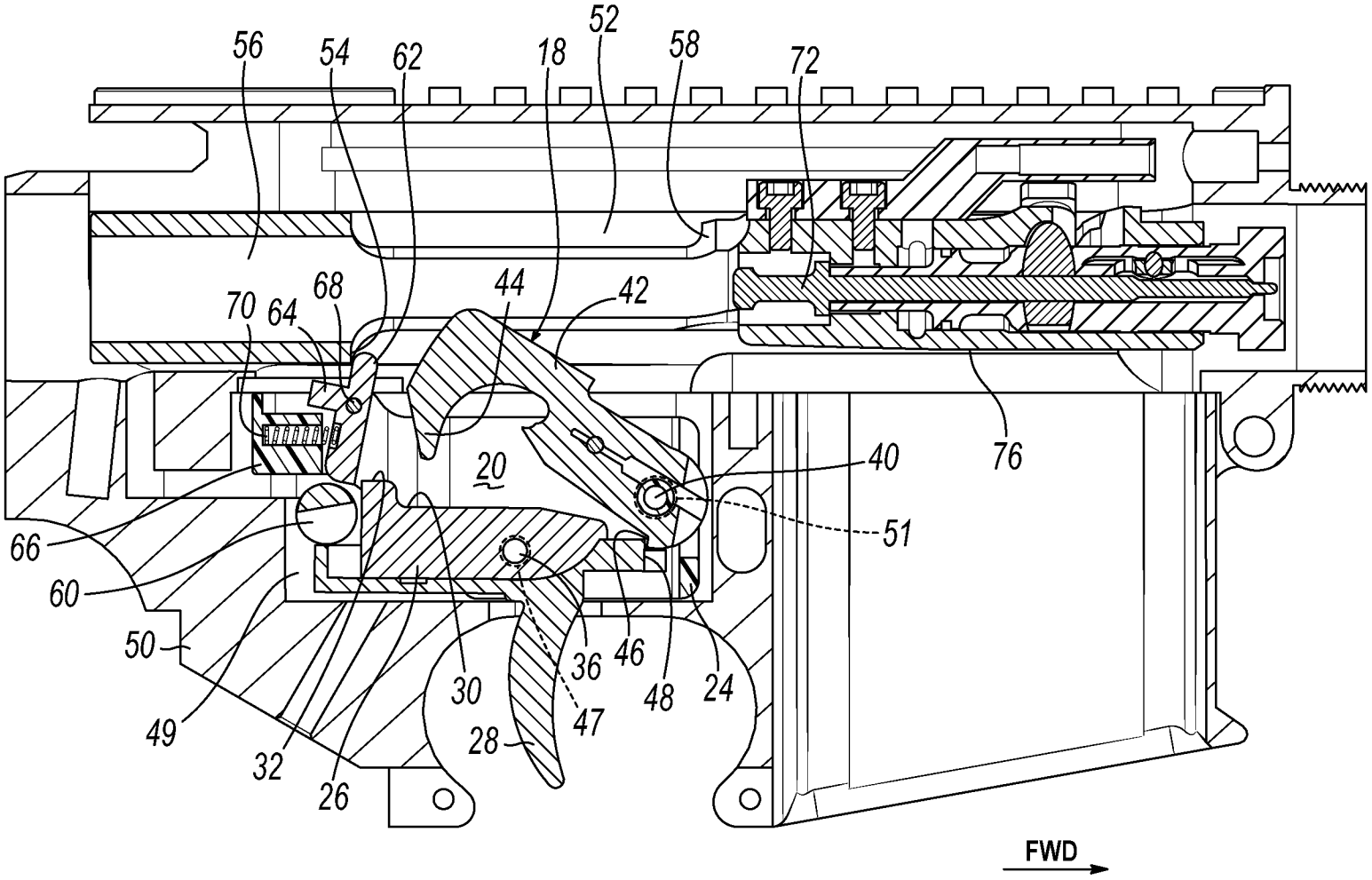
FIG. 3 is a longitudinal section view showing the module of the embodiment installed in a typical AR15-pattern lower receiver in a cocked and ready to fire status with the bolt and bolt carrier in an in-battery position.
Figure 4:
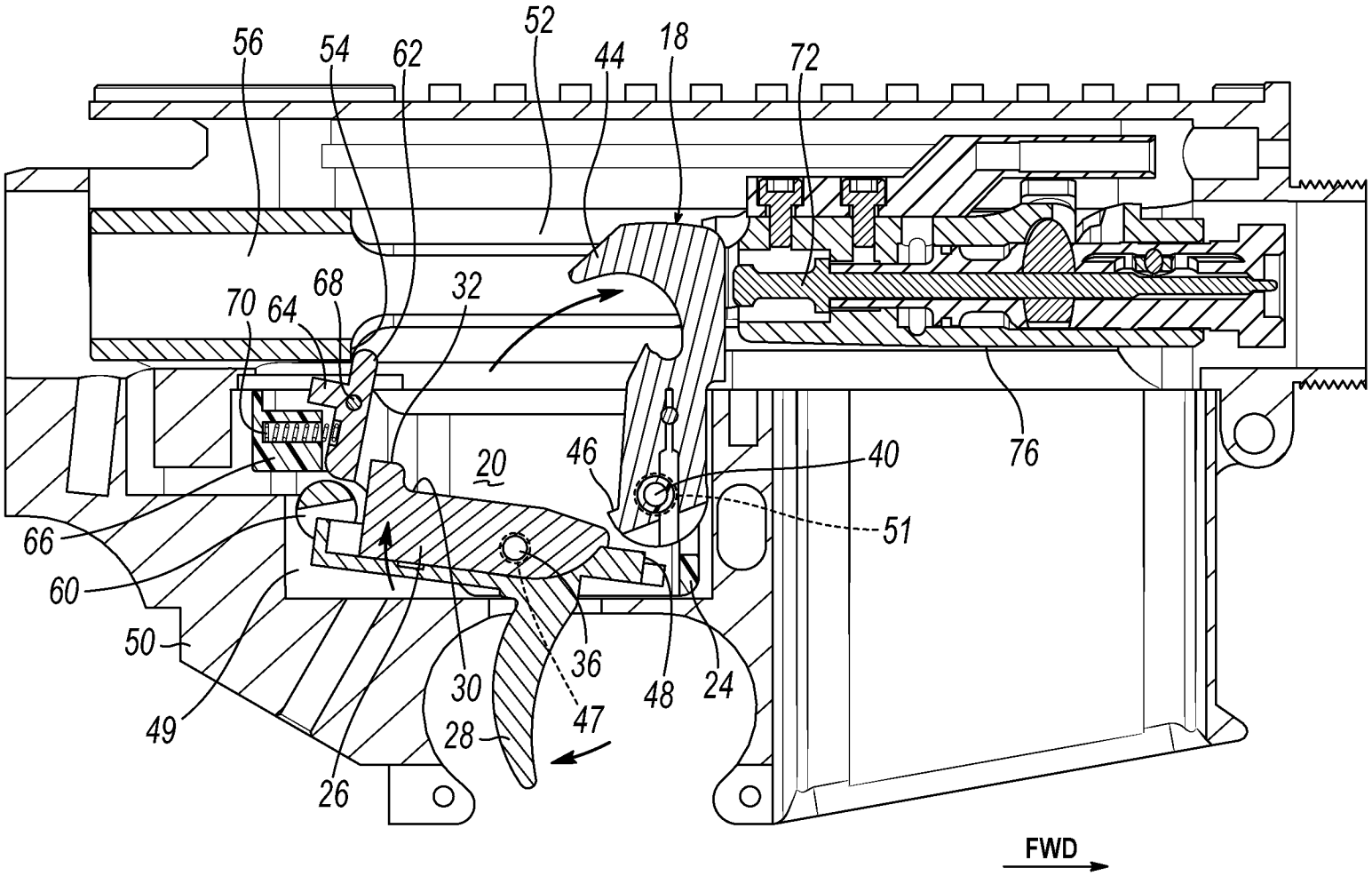
FIG. 4 is a similar view in which the trigger has been pulled and the hammer has fallen against a firing pin.
Figure 5:
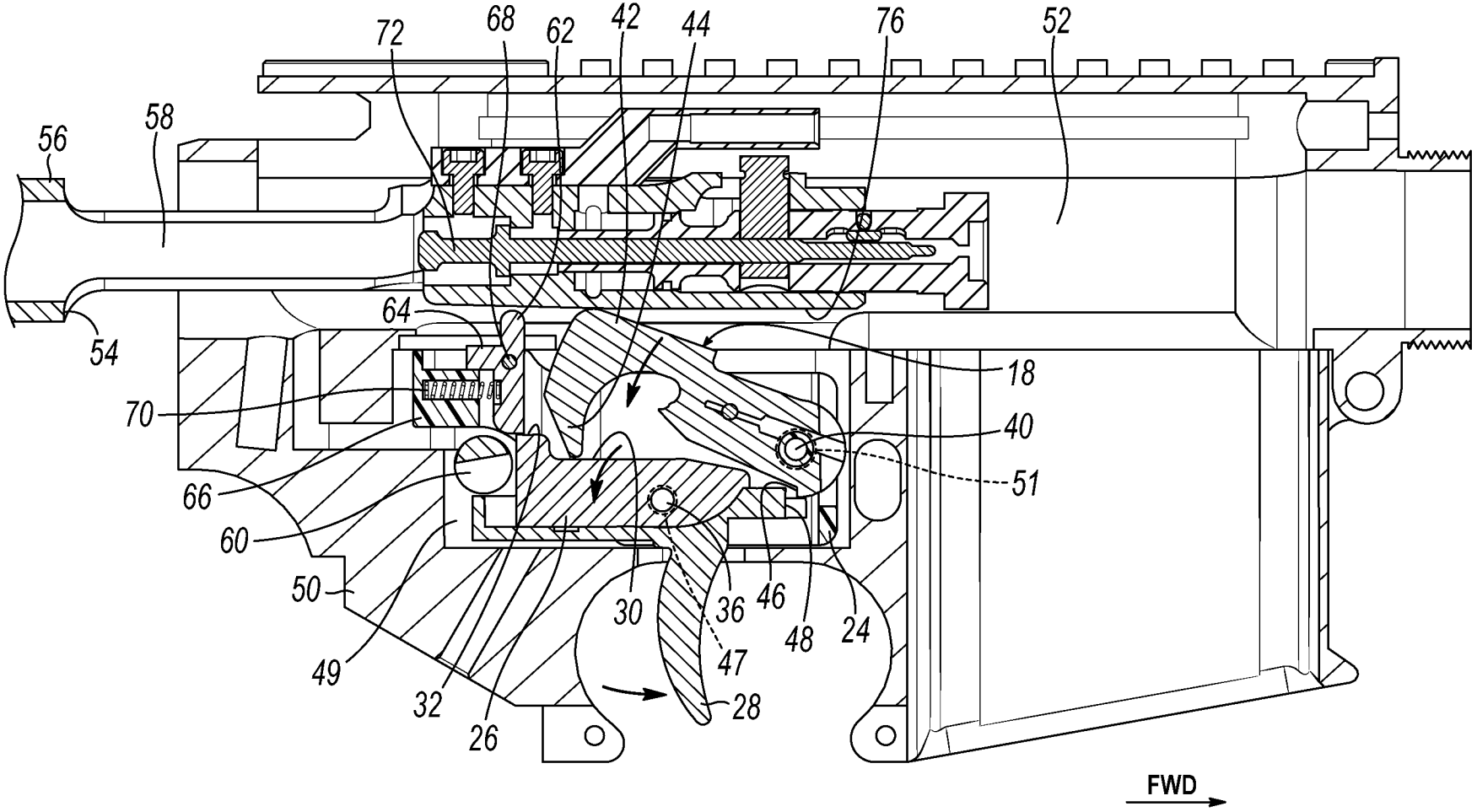
FIG. 5 is a similar view showing the bolt carrier in a retracted position, forcing the hammer and trigger into a reset status.

A modified trigger member 26 may be sized to fit between the sidewalls 20, 22 of the housing 12 and may include a trigger blade portion 28 that extends downwardly. The trigger blade portion 28 is the part of the trigger member 26 contacted by a user's finger to actuate the trigger mechanism. The trigger blade portion 28 may be curved (shown) or straight, as desired. The trigger member 26 may pivot on a transverse pin 36 (not shown in FIGS. 1 and 2) that extends through aligned openings 16 in the sidewalls 20, 22 of the housing 12. The same pin 36 is aligned and positioned within aligned openings 47 of a lower receiver 50 to assemble the module 10 into a fire control mechanism pocket 49 of the lower receiver 50, as shown in FIGS. 3-5, for example. The modified trigger member 26 may have integral first and second contact surfaces 30, 32. Some part of the trigger member 26 includes contact surfaces for interaction with the hammer 18 and locking bar 62. For example, the trigger member 26 can include first and second upwardly extended rear contact surfaces 30, 32. The first contact surface 30 is positioned to interact, for example, with a tail portion 44 of the hammer 18 that extends rearwardly from a head part 42 of the hammer 18. The second contact surface 32 is positioned to interact with a locking bar 62. The contact surfaces may be integral to a specially formed trigger body or may be a separate insert (shown) that is made to closely fit and mate with a standard AR-pattern trigger member, held in place by the trigger pin 36, with no lost motion between the parts.

The hammer 18 may include bosses 34 coaxial with a transverse pivot pin opening 38 that receives an assembly/pivot pin 40 (not shown in FIGS. 1 and 2) through the first set of aligned openings 14 in the housing 12 (and through openings 51 in the firearm receiver, to position the trigger module 10 within the fire control mechanism pocket 49 of the lower receiver 50, as shown in FIGS. 3-5). The bosses 34 may fit between the sidewalls 20, 22 of the housing 12 to laterally position the hammer 18, or can be received in the openings 14 (if enlarged) so that the hammer 18 stays assembled with the module 10 when the hammer's pivot pin is removed and/or when the module 10 is not installed in a firearm receiver. The hammer 18 includes a head portion 42 and a tail portion 44. The hammer 18 also includes a sear catch 46 that engages the sear 48 on the trigger member 26, when cocked. The trigger and hammer pins 36, 40 provide pivot axes at locations (openings 47, 51, shown in FIGS. 3-5, for example) standard for an AR-pattern fire control mechanism. Although FIGS. 3-5 are a longitudinal section view and only show one of the aligned openings 47, 51, it is understood that a typical AR15-pattern lower receiver 50 includes second, corresponding and aligned openings 47, 51 in the half of the receiver 50 not shown).

Referring now also to FIG. 3, the trigger module 10 is shown installed in the fire control mechanism pocket 49 of an AR-pattern lower receiver 50. Other lower receiver parts not important to the present invention are well-known in the art and are omitted from all figures for clarity. As is well-known in the art, the bolt carrier assembly 52 (or blow-back bolt) would be carried by an upper receiver (not shown) and engage the breach of a barrel or barrel extension. As used herein, "bolt carrier" and "bolt carrier assembly" may be used interchangeably and include a blow-back type bolt used in pistol caliber carbine configurations of the AR-platform. The hammer 18 is shown in a cocked position and a bolt carrier assembly 52 is shown in an in-battery position. The sear 48 engages the sear catch 46 of the hammer 18.

The bolt carrier assembly 52 used with the embodiments of this invention can be an ordinary (mil-spec) M16-pattern bolt carrier assembly, whether operated by direct impingement or a gas piston system, that has a bottom cut position to engage an auto sear in a fully automatic configuration. The bottom cut creates an engagement surface 54 in a tail portion 56 of the bolt carrier body 58. This is distinct from a modified AR15 bolt carrier that is further cut-away so that engagement with an auto sear is impossible. The semiautomatic AR-pattern safety selector switch 60 may also be standard (MIL-SPEC) in all respects.

The trigger module of the present invention includes a trigger locking bar 62 carried on a frame 66 for pivotal movement on a transverse pivot pin 68. The frame 66 may be part of the module housing 12, if configured as a "drop-in" unit. An upper end of the locking bar 62 extends above the upper edge of the housing 12 and lower receiver 50 to be engaged by the engagement surface 54 of the bolt carrier body 58 when the bolt carrier assembly 52 is at or near its in-battery position (as shown in FIG. 3). Contact between the engagement surface 54 and upper end of the locking bar 62 causes the locking bar 62 to pivot into a first position (FIG. 3) against a biasing spring 70 and allows pivotal movement of the trigger member 26. If desired, the locking bar 62 may include a rearward extension 64 that serves as a means to limit the extent to which it can pivot toward the blocking position.

Referring now also to FIG. 4, when the safety selector 60 is in the "fire" position (as shown in all figures), finger pressure pulling rearward against the trigger blade portion 28 causes the trigger member 26 to rotate on the pivot pin 36, as indicated by arrows. This rotation causes the sear 48 to disengage from the sear catch 46 of the hammer 18. This release allows the hammer 18 to rotate by spring force (hammer spring omitted for clarity) into contact with the firing pin 72. Any contact between the rear portion of the trigger member 26 and front surface of the locking bar 62 will simply cause the locking bar 62 to rotate out of the way, as illustrated in FIG. 4.

Referring now to FIG. 5, discharging an ammunition cartridge (not shown) causes the action to cycle by moving the bolt carrier assembly 52 rearwardly, as illustrated. The same effect occurs when the action is cycled manually. As in an ordinary AR15-pattern configuration, a lower surface 76 of the bolt carrier body 58 pushes rearwardly against the head portion 42 of the hammer 18, forcing it to pivot on the hammer pivot/assembly pin 40 against its spring (not shown) toward a reset position. As the rearward movement of the bolt carrier body 58 and pivotal movement of the hammer 18 continues, mechanical interference or contact between a rear surface 74 of the hammer 18 (such as on the tail portion 44) and a contact surface 30 of the trigger member 26 forces the trigger to pivot (arrows in FIG. 5) toward and to its reset position. At the same time, as the trigger member 26 is reset, the biasing spring 70 moves the lower end of the locking bar 62 into a second position (FIG. 5) in which it blocks pivotal movement of the trigger 26, including by finger pressure applied (or reapplied) to the trigger blade 28. Thus, as the bolt carrier assembly 52 returns forward, the trigger member 26 is held in its reset position by the locking bar 62 where the hammer sear catch 46 will engage with the sear 48 carried on the trigger member 26 to reset the fire control mechanism. The trigger member 26 cannot be pulled to release the sear/hammer engagement, thus precluding early hammer release or "hammer follow" against the bolt carrier assembly 52 and firing pin 72 as the bolt carrier assembly 52 is returning to battery. A trigger return spring (not shown) of the type used in a standard AR-pattern trigger mechanism may be unnecessary in this case, because the trigger member 26 is forced to return by the hammer 18, but may be used, if desired.

When the bolt carrier assembly 52 has reached (or nearly reached) its closed, in-battery position (shown in FIG. 3), the engagement surface 54 of the bolt carrier tail portion 56 contacts and forwardly displaces the upper end of the locking bar 62, disengaging the second contact surface 32 of the trigger member 26, allowing the trigger 26 to be pulled a second time. The distance of travel during which there is no interference between the locking bar 62 and second contact surface 32 of the trigger member 26, allowing the trigger member 26 to be manually displaced, may be about from about 0.10 to 0.31 inch. This prevents early release of the hammer 18 and contact of the hammer against the firing pin 72 before the bolt is completely locked and in-battery.

Force applied by the user's trigger finger against the trigger blade portion 28 is incapable of overcoming the mechanical interference and force of the hammer 18 against the contact surface 30 of the trigger member 26. However, the trigger can immediately be pulled again—only by application of an external force—as soon as the locking bar 62 has been rotated against the spring 70 and out of blocking engagement with the trigger member 26, as the bolt carrier assembly 52 approaches or reaches its in-battery position. This allows the highest possible standard rate of fire, without risk of hammer-follow, for the semiautomatic action of the firearm.

While various embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. For a firearm having a receiver with a fire control mechanism pocket, transversely aligned pairs of hammer and trigger pin openings in side walls of the pocket, and a bolt carrier that reciprocates and pivotally displaces a hammer when cycled, a trigger mechanism, comprising:

a hammer having a sear notch and mounted in the fire control mechanism pocket to pivot on a transverse hammer pin between set and released positions;

a trigger member having a sear and mounted in the fire control mechanism pocket to pivot on a transverse trigger pin between set and released positions, the trigger member having a surface positioned to be contacted by the hammer when the hammer is displaced by cycling of the bolt carrier, the contact causing the trigger member to be forced to the set position;

a locking bar pivotally mounted in a frame and spring biased toward a first position in which the locking bar mechanically blocks the trigger member from moving to the released position, and movable against the spring bias to a second position when contacted by the bolt carrier reaching a substantially in-battery position, allowing the trigger member to be moved by an external force to the released position.

2. The trigger mechanism of claim 1, wherein the trigger member has a second surface positioned to be contacted by the locking bar when the locking bar is in the first position.

3. The trigger mechanism of claim 1, wherein the locking bar includes means for limiting the extent to which the locking bar can pivot by the spring bias toward the first position.

4. For a firearm having a receiver with a fire control mechanism pocket, assembly pin openings in side walls of the pocket, and a bolt carrier that reciprocates and pivotally displaces a hammer when cycled, a trigger mechanism, comprising:

a housing having transversely aligned pairs of openings for receiving hammer and trigger assembly pins;

a hammer having a sear notch and mounted in the housing to pivot on a transverse axis between set and released positions;

a trigger member having a sear and mounted in the housing to pivot on a transverse axis between set and released positions, the trigger member having a surface positioned to be contacted by the hammer when the hammer is displaced by the bolt carrier when cycled, the contact causing the trigger member to be forced to the set position;

a locking bar pivotally mounted in the housing and spring biased toward a first position in which the locking bar mechanically blocks the trigger member from moving to the released position, and movable against the spring bias to a second position when contacted by the bolt carrier reaching a substantially in-battery position in which the trigger member can be moved by an external force to the released position.

5. The trigger mechanism of claim 4, wherein the trigger member has a second surface positioned to be contacted by the locking bar when the locking bar is in the first position.

6. The trigger mechanism of claim 4, wherein the housing's transversely aligned pairs of openings for receiving hammer and trigger assembly pins are aligned with the assembly pin openings in the fire control mechanism pocket of the receiver.

7. The trigger mechanism of claim 4, wherein the locking bar includes means for limiting the extent to which the locking bar can pivot by the spring bias toward the first position.

* * * * *